United States Patent [19]

Kujirai et al.

[11] Patent Number: 4,800,581

[45] Date of Patent: Jan. 24, 1989

[54] X-RAY TUBE

[75] Inventors: Masaji Kujirai, Ohtawara; Yoshio Fukuhara, Yokohama, both of Japan

[73] Assignee: Kabushiki Kaisha Toshiba, Kawasaki, Japan

[21] Appl. No.: 111,255

[22] Filed: Oct. 22, 1987

[30] Foreign Application Priority Data

Oct. 27, 1986 [JP] Japan ..... 61-255147
Oct. 27, 1986 [JP] Japan ..... 61-255148

[51] Int. Cl.[4] ..... H01J 35/08

[52] U.S. Cl. ..... 378/143; 378/125; 378/144

[58] Field of Search ..... 378/125, 143, 144

[56] References Cited

U.S. PATENT DOCUMENTS 3,610,984 10/1971 Seki et al. ..... 378/125
3,737,699 6/1973 Gager ..... 378/144
3,778,654 11/1973 Hueschen et al. ..... 378/125
4,731,805 3/1988 Boyarina et al. ..... 378/143

FOREIGN PATENT DOCUMENTS 60-198045 10/1985 Japan .
62-15739 1/1987 Japan .
1121407 7/1968 United Kingdom .

*Primary Examiner*—Carolyn E. Fields
*Assistant Examiner*—David P. Porta
*Attorney, Agent, or Firm*—Oblon, Fisher, Spivak, McClelland & Maier

[57] ABSTRACT

An X-ray tube is provided with a target that radiates primarily the characteristic X-ray of molybdenum. The target has an electron focal area of molybdenum base alloy containing molybdenum as a major component, and at least one of titanium and a combination of potassium oxide and silicon dioxide.

8 Claims, 8 Drawing Sheets

X-RAY TUBE

BACKGROUND OF THE INVENTION

1. Field of the Invention

This invention relates to an X-ray tube, and more particularly to an X-ray tube provided with a target radiating the characteristic X-ray of molybdenum.

2. Description of the Prior Art

In mammography that performs X-ray photography of mammae is performed by the use of low energy X-rays from an X-ray tube using a Mo (molybdenum) target that radiates X-rays. These X-rays contains wavelength components of approximately 0.4 to 0.8 angstrom. In this case, the target (anode) acceleration voltage is on the order of 25 to 40 kV. Specifically, to take an X-ray photograph having fewer geometric blurs, the focal point should be as small as possible. On the other hand, to obtain a sufficient amount of X-ray radiation, a tube current of approximately 100 mA or more is usually required, so the focal point becoming larger. In general, an X-ray photograph is taken using X-ray radiation for a relatively long time, such as 1 to 4 seconds, for example. This results in heating electron focal area of the anode target to a high temperature, so that the electron focal area is susceptible to damage upon repeated operation. Namely, the electron focal area frequently exceeds a temperature of 1700° to 1800° C., i.e., the recrystallization temperature of pure Mo. As a result, the metallic crystals of the electron focal area grow large and the surface of the focal area becomes rough. When such thermal fatigue thereof progresses, the amount of X-ray radiation is reduced, and the X-ray radiation quality becomes progressively harder.

Therefore, in order to alleviate damage to the electron focal area of the target, various alloys have been utilized as materials of the electron focal area. For example, the use of a Mo-Hf (hafnium) alloy was disclosed in Japanese Patent Application Laid-open No. 49-45692. Also, the use of an alloy of Mo and one of 25 wt % or less of a metallic element, having an atomic number between 39 and 46, for example, Nb (niobium) was disclosed in Japanese Patent Application Laid-open No. 49-45693. However, there were no notable improvements with these alloys in comparison with a pure Mo target. With pure W (tungsten) or an alloy of R (rhenium) and W used as the material of the electron focal area, desired characteristic X-rays of Mo cannot be obtained. Also, a complex target of pure W or a Re-W alloy has been used as a material for the electron focal area, and the supporting target base thereof was made of a Mo alloy having large heat capacity (disolosed in Japanese Patent laid open No. 60-198045, and British Patent No. 1,121,407). Mo characteristic X-rays could not be obtained with this structure.

When a conventional X-ray tube with a target made of pure Mo was subjected to a forced operation test, corresponding to repetitive operations of a considerably long time. The state of the target surface became deteriorated at the end of the test, as shown in FIGS. 10 and 11. FIG. 10 is a photomicrograph that shows the rotary anode target surface made of pure Mo enlarged to 5 times the actual size. FIG. 11 is a photomicrograph that shows a portion of the electron focal area enlarged to 30 times the actual size. From these photomicrographs, it can be confirmed that the crystals of the electron focal area of the pure Mo target became larger, and experienced a lot of deep cracks. This test was performed under such conditions that the anode acceleration voltage was 40 kV, the tube current was 150 mA, and 4-second electron bombardments were made repeatedly 400 times at 75-second intervals. In addition, another forced operation test was performed under such conditions that the anode acceleration voltage was 40 kV, the tube current was 260 mA, and 1-second bombardments were made repeatedly 5000 times at 50-second intervals. After this test, it was confirmed that the amount of X-ray radiation was reduced to a value of approximately 46% of the initial amount, as shown in the curve L in FIG. 2, showing the comparison among X-ray radiation characteristics of the invention and the prior arts.

SUMMARY OF THE INVENTION

Accordingly, one object of this invention is to provide an X-ray tube having a Mo target that can resist roughened and enlargement of crystal grains of electron focal area and can maintain the amount of X-ray radiation even after long-time repetitive operations.

Briefly, in accordance with one aspect of this invention, there is provided an X-ray tube that comprises a cathode for emitting electrons, and a target provided with an electron focal area to receive impact of the electrons and for radiating primarily characteristic X-rays of Mo. The target comprises a supporting base with the electron focal area disposed thereon, and the electron focal area includes a Mo base alloy that contains Ti (titanium), $K_2OSiO_2$ (combination of potassium oxide and silicon dioxide) or mixtures thereof. More preferably, the Mo alloy contains Ti of about 0.3 to about 4 wt % or a combination of $K_2$) of about 0.01 to about 0.1 wt % and $SiO_2$ of about 0.02 to about 0.3 wt %.

According to the invention, the electron focal area having a non-rough surface even after repeated operations at heavy loads. Thus, the reduction of the amount of X-ray radiation in the desired direction can be significantly restricted. This allows the X-ray tube to possess long-life properties.

By the bombardment of electrons, the surface temperature of the electron area on the target base reaches a temperature of approximately 2600° C., which is significantly higher than the surface temperature (approximately 1200° C.) of the target base. As a result, the thermal influence reaches a depth of approximately 0.1 mm. Therefore, the electron focal area should be 0.2 mm in thickness at a minimum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
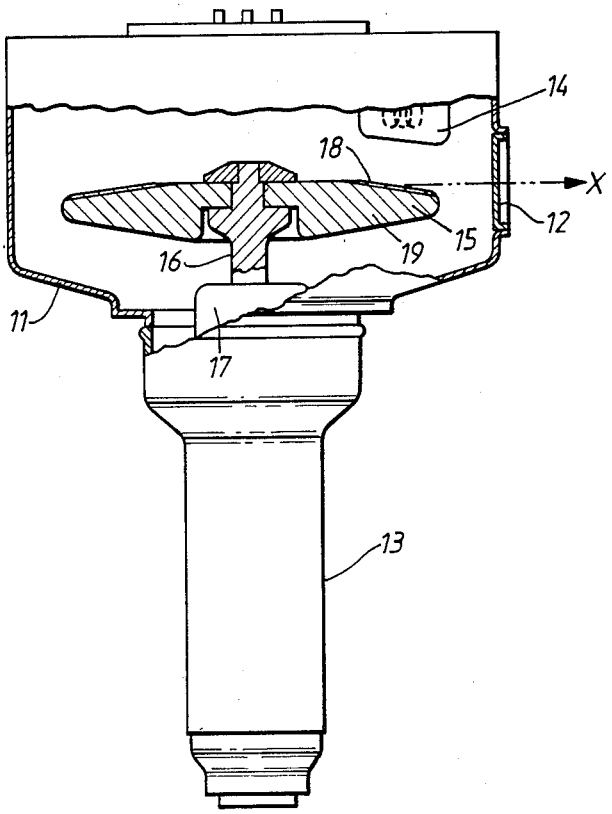
FIG. 1 is a partially cutaway view illustrating one embodiment according to the present invention.

Referring now to the drawings, wherein like reference numerals designate identical or corresponding parts throughout the several views, and more particularly to FIG. 1 thereof, one embodiment of present invention now will be described.

FIG. 1 is a schematic configuration diagram illustrating an X-ray tube of the present invention adapted to a rotary anode type X-ray tube for use in mammography. In FIG. 1, a metallic vacuum envelope 11 is provided with an X-ray radiation window 12, which is primarily made of a beryllium thin plate and hermetically sealed to a portion of the metallic vacuum envelope 11. A glass rotor envelope 13 extends in the direction of the tube axis. A cathode structure 14 is disposed on the end of the metallic vacuum envelope 11 opposing the glass rotor container 13. A rotor 17 is rotatably supported by the glass rotor envelope 13. A rotatable disc-shaped anode target 15 is supported by a supporting shaft 16 extended from the rotor 17. A high voltage is applied between the cathode 14 and the anode target 15 to which a positive potential side of the high voltage is connected. When electrons are discharged from the cathode 14, the electrons are accelerated and focused into on electron beam which is impinged on an electron focal area 18 of the rotatable anode target 15. An X-ray beam is produced an radiated outside window 12 in the arrow-marked direction X.

Figure 3:
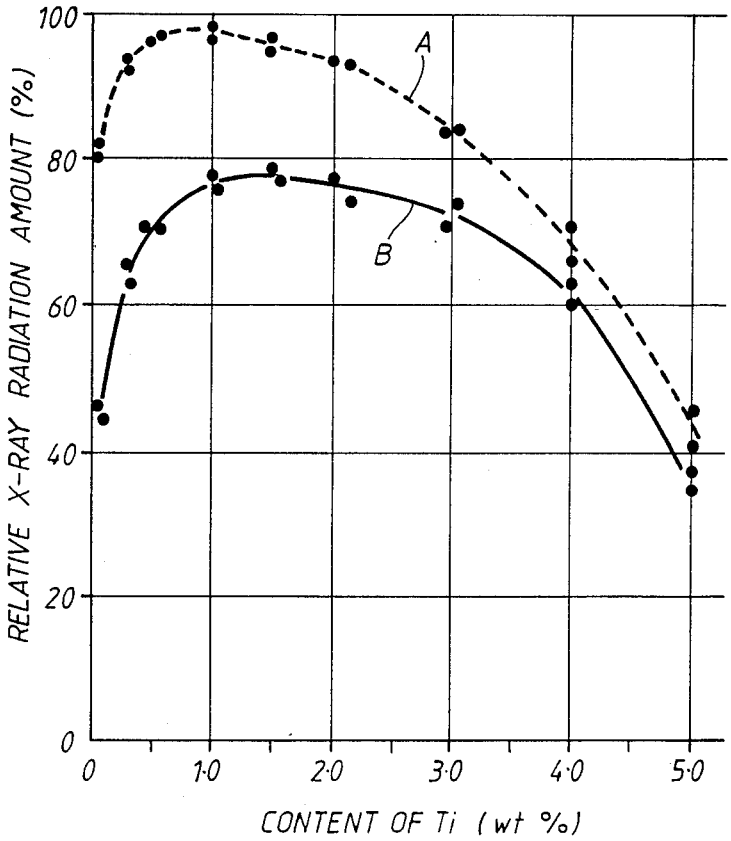
FIG. 3 is a graph for explaining characteristics of one embodiment according to the present invention, and illustrating relative X-ray radiation amounts with respect to Ti contents, with the number of times of electron bombardment as parameters.

The rotatable anode target 15 comprises an electron focal area 18 and a supporting base 19. Both of area 18 and base 19 are made of a Mo base alloy containing major amount of Mo and a small amount of Ti, and additionally a small amount of C (carbon) as a deoxidizer. Preferably, the Ti content is in a range of 0.3 to 4 wt % and the C content is in a range of 50 to 400 ppm (as the aim composition of the target). Namely, FIG. 3 shows the relationship between the Ti content (wt %) with respect to the Mo of the electron focal area and the relative amount of X-ray with the number of times of electron bombardment as parameters, wherein the C content is determined to be approximately 200 ppm. Here the electron bombardment was performed such that a voltage of 40 kV was applied across the target 15 and the cathode 14, and 1-second bombardments of electron current of 260 mA were made at 50-second intervals. In FIG. 3, the curve A represents the values obtained after 1000-times of electron bombardments, and the curve B represents the values obtained after 5000-times of electron bombardments. From these curves A and B, it can be understood that most preferable X-ray radiation amounts may be obtained when Ti content is in the range of 0.6 to 2.0 wt %. However, it also can be seen that the Ti contents between 0.3 to 4.0 wt % that can secure the X-ray radiation amounts of 60% or more even after 5000 times of bombardments can be practically acceptable. Moreover, C functions as a deoxidizer, and is not absolutely required. However, when present, C remains dispersed between the elements of Mo and Ti, and a portion of the C also remains as a form of TiC after vacuum sintering, whereby the structure of metallic crystals of the electron focal area of the target can be restrained from growth. As a result the surface of focal area 18 remains substantially flat.

When the Ti content is excessively small, the Mo-Ti alloy is about the same as pure Mo,. but when it is too large, free Ti that does not combine with Mo may be present. The free Ti evaporates when the electron focal area 18 reaches a temperature of 2600° C., and this evaporation of the free Ti can be considered to cause unevenness of the area 18.

Next, the description will be made as to specific examples.

A mixed powder was prepared such that $TiH_2$ powder=1 wt %, C powder=100 ppm and remainder=Mo powder. All the powder was uniformly mixed. Next, the mixed powder was formed into pellets, and was heated within a vacuum furnace at a temperature of 2000° C. for 2 hours, whereby a sinter was obtained. Thereafter, the thus obtained sintered body was formed so as to be densified, and further forged into a certain specified shape. Next, the thus forged body was machined, and then put into the vacuum furnace with a pressure of $1\times10-5$ Torr of less, wherein the machined body was heated at a temperature which was below its recrystallization temperature (approximately 1400° C.) for 2 hours so that degas treatment was performed. As a result, an X-ray tube target was obtained, which was assembled into the X-ray tube envelope.

Figure 6:
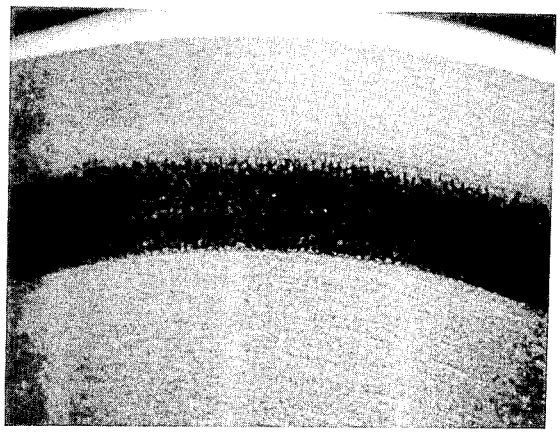
FIG. 6 is a hotomicrograph showing the electron focal area of a target in one embodiment according to the present invention.
Figure 7:
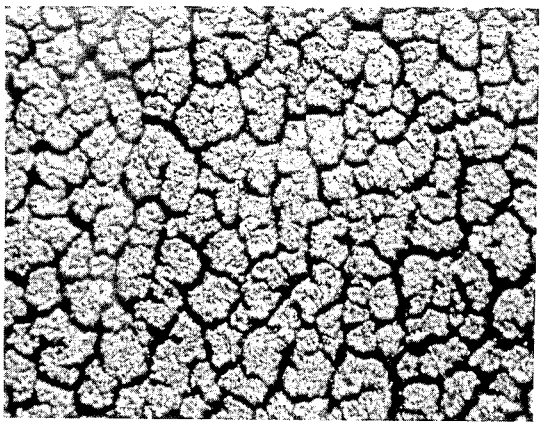
FIG. 7 is a photomicrograph showing an enlarged view of the focal area essential portion of FIG. 6.

The X-ray tube thus obtained was put, in the same manner as in the above-described prior art, through a forced operation test such that anode acceleration voltage=40 kV, tube current=150 mA, and 4-second bombardments on the rotating anode were repeatedly performed 400 times at 75-second intervals After this test, the electron focal area 18 was examined by the photomicrographs thereof such as FIG. 6 of 5×magnification and FIG. 7 of 30×magnification. From these observations, it was confirmed that although many cracks occurred on the electron focal area 18, the crystals thereof were significantly restrained from becoming rough and large in comparison with those of pure Mo.

Figure 2:
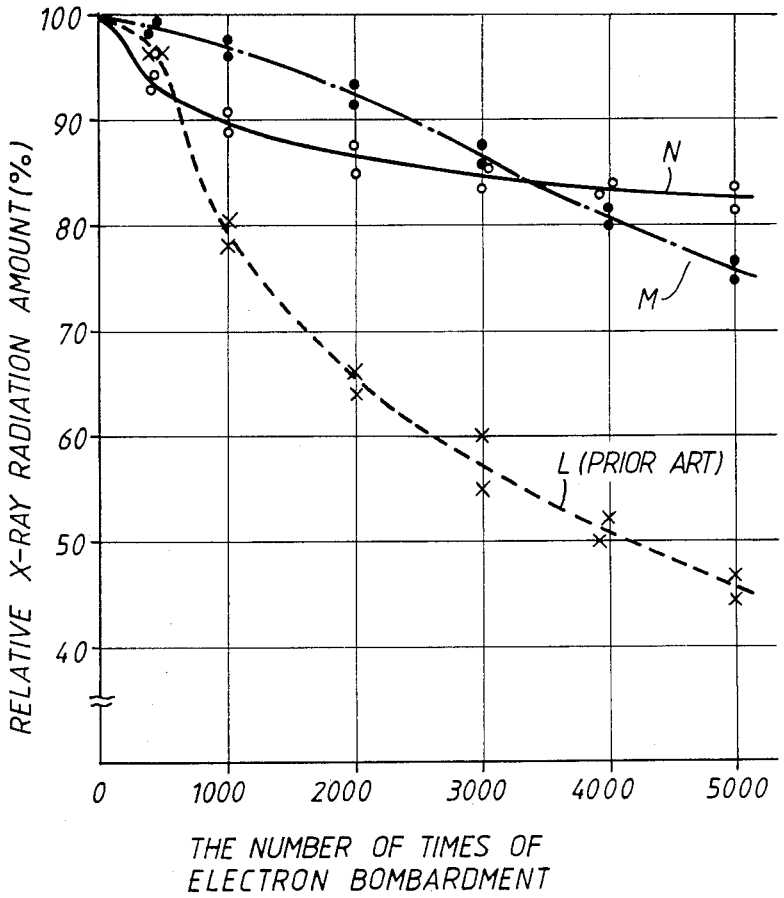
FIG. 2 is a graph for comparing characteristics of the present invention and the prior art, and illustrating relative X-ray radiation amounts with respect to the number of times of electron bombardment.

In addition, another forced operation test was carried out such that anode acceleration voltage=40 kV, tube current=260 mA, and 1-second bombardments were repeatedly performed 5000 times at 50-second intervals. The result is shown by the curve M in FIG. 2, wherein the X-ray radiation amount after this test remained at a value of approximately 76% of that in the initial period, and this fall became smaller as compared to the fall in the case of pure Mo. Moreover, the X-ray radiation quality was substantially the same as the X-ray radiation quality of Mo and there was almost no change attributable to the test.

As described above, the X-ray tube according to the present invention exhibits superior long-life properties as in X-ray generating source for use in mammography.

Moreover, the target may contain, besides Ti and additional C, extremely small amounts of other metal elements as a trace.

Another embodiment will be described hereinafter. An electron focal area 18 of a rotatable anode target 15 is made of Mo base alloy containing Mo as a major component, and a combination of oxides, i.e., $K_2O$ and $SiO_2$ as an additive. A supporting base 19 is also made of the Mo alloy, the same as the focal area. Preferably, the $K_2O$ content is in a range of 0.02 to 0.3 wt %. More preferably, the $K_2O$ content is in a range of 0.02 to 0.06 wt %, and the $SiO_2$ content is in a range of 0.06 to 0.1 wt %. When the contents of $K_2O$ and $SiO_2$ are smaller than the above-described range, a sufficient restraint effect to restrain the electron focal area from becoming crystrallized cannot be obtained. To the contrary, when they are greater than the above-described values, these surplus metals evaporate during the operation of X-ray tube. The evaporation of these metals can readily cause an increase of gases within the tube and also cause deterioration of voltage characteristics.

Figure 4:
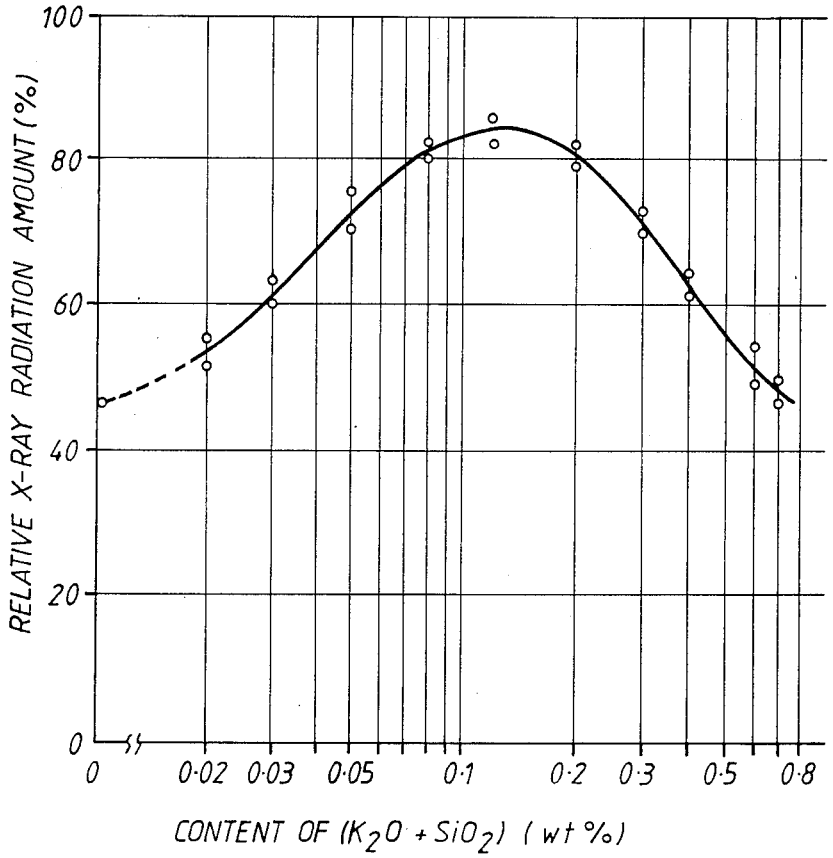
FIG. 4 is a graph for explaining characteristics of another embodiment according to the present invention, and illustrating the relationship between relative X-ray radiation amounts and contents of ($K_2O+SiO_2$)

FIG. 4 shows the relationship between the content of $K_2O$—$SiO_2$, i.e., ($K_2O+SiO_2$) and the relative amount of X-ray radiation after 5000-times bombardment, where the initial X-ray radiation amount is defined as 100%. As can be seen from FIG. 4, When the ($K_2O+SiO_2$) content is in the range of 0.03 to 0.4 wt %, the relative X-ray radiation amount is maintained at 60% or more, which is a practically acceptable range. When ($K_2O+SiO_2$) content is in the range of 0.07 to 0.2 wt %, the relative X-ray radiation amount is maintained at 80% or more, which is a more preferable range.

Figure 5:
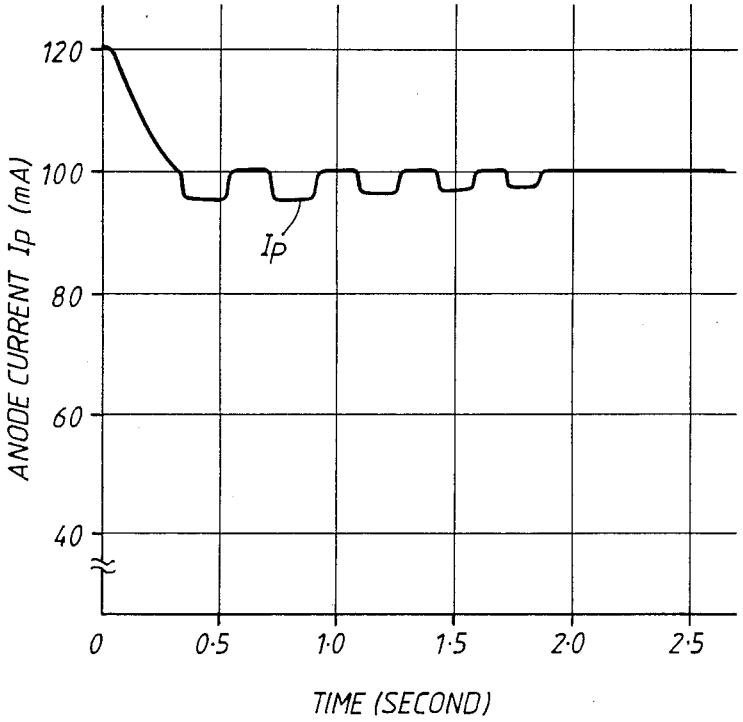
FIG. 5 is a graph illustrating characteristics of anode current with respect to time in the embodiment explained with the graph in FIG. 4.

Further, when the contents of $K_2O$—$SiO_2$ are excessively greater, the anode current Ip becomes unstable and fluctuates, as shown in FIG. 5. FIG. 5 shows characteristics of the anode current when a voltage of 40 kV was applied between the cathode and target, and the electron focal area contained $K_2O$ of 0.2 wt % and $SiO_2$ of 0.5 wt %.

Next, the specific examples will be described.

First, aqueous solutions of KCl and $SiO_2$ were added to an Mo intermediate oxide powder and mixed such that $K_2O$=0.07 wt % and $SiO_2$=0.10 wt %. Thereafter, the mixture was dried to be dehydrated, and then was heated within the hydrogen furnace at a temperature of approximately 750° C. for 1 hour so as to be deoxidized. Consequently, a doped Mo powder was obtained. Next, the thus obtained powder was formed into pellets, and heated within the hydrogen furnace at a temperature of approximately 1800° C. for 7 hours. Thus, the sinter was obtained. Thereafter, the sintered body was forged to be densified, and was further forged into a certain specified shape. Next, the thus forged body was machined and then put into the vacuum furnace with a pressure of $1\times10^{31\ 5}$ Torr or less to be degassed at a temperature which was below its recrystallization temperature (approximately 1400° C.) for 2 hours, so an X-ray tube target obtained.

Figure 8:
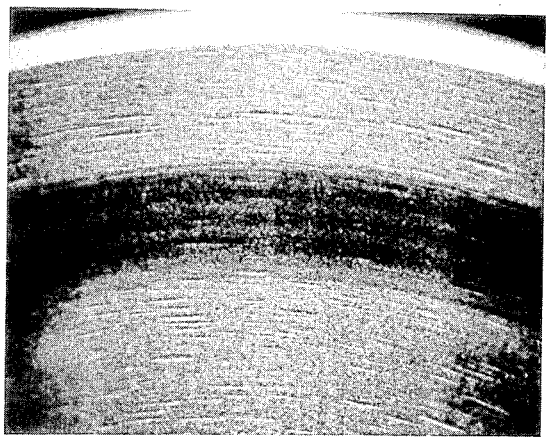
FIG. 8 is a photomicrograph showing the electron focal area of a target in another embodiment according to the present invention.
Figure 9:
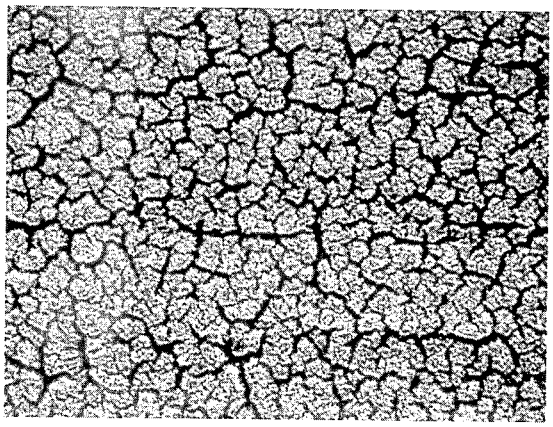
FIG. 9 is a photomicrograph showing an enlarged view of the focal area of FIG. 8.
Figure 10:
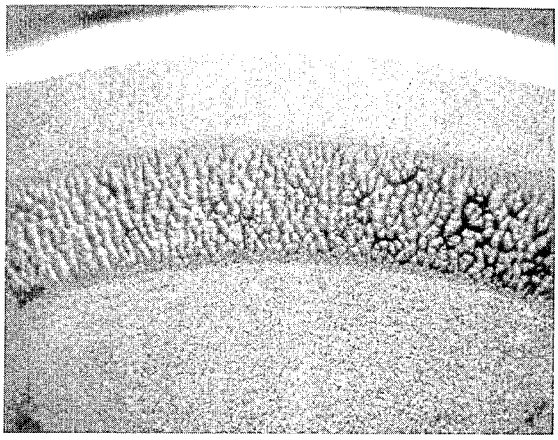
FIG. 10 is a photomicrograph showing the electron focal area of a target in the prior art X-ray tube.
Figure 11:
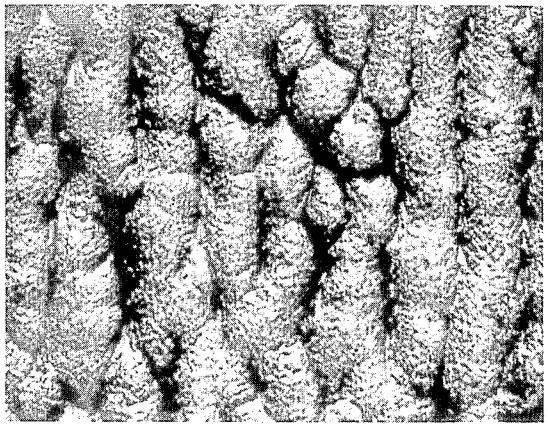
FIG. 11 is a photomicrograph showing an enlarged view of the focal area of FIG. 10.

The X-ray tube assembled with the target was put through a forced operation test in the same manner as in the above-described embodiment such that anode acceleration voltage=40 kV, tube current=150 mA, and 4-second bombardments were repeatedly performed 400 times at 75-second intervals. After this test, the electron focal area 18 was examined by the photomicrographs thereof such as FIG. 8 of 5× magnification and FIG. 9 of 30× magnification. From these observations, it was confirmed that, although many cracks occurred on the electron focal area 18, the crystals thereof were significantly restrained from becoming rough and large in comparison with those of pure Mo.

In addition, another forced operation test was carried out such that the anode acceleration voltage=40 kV, the tube current=260 mA, and 1-second bombardments were repeatedly performed 5000 times at 50-second intervals. The result is shown by the curve N in FIG. 2, wherein the amount of X-ray radiation at the end of the test remained at a value of approximately 83% of that in the initial amount, and this fall became smaller as compared to the fall in the case of pure Mo.

Moreover, the X-ray radiation quality was substantially the same as the X-ray radiation quality of pure Mo, and there was almost no change attributable to the test.

As described above, the X-ray tube according to the present invention exhibits superior long-life properties as an X-ray generating source for use in mammography.

As still another embodiment, Ti and $K_2O$—$SiO_2$ of contents which are in the range of the abovementioned embodiments may be added to and mixed with the major constituent, i.e., Mo. Thus, desired target can be obtained.

Furthermore, in the abovementioned embodiments, the target is an integrated electron focal area and supporting base. However, a complex target with the supporting base formed of different materials, such as pure Mo and Mo-W alloy, can also be utilized. This electron focal area should be formed with a thickness of 0.2 mm or more, because cracks of approximately 0.1 mm in depth caused by the influence of heat generated by the electron bombardment may develop.

Obviously, numerous additional modifications and variations of the present invention are possible in light of the above teachings. It is therefore to be understood that within the scope of the appended claims, the invention may be practiced otherwise than as specifically described herein.

What is claimed is:

1. An X-ray tube comprising:

cathode means for emitting electrons; and target means for radiating primarily characteristic X-rays of molybdenum, including an electron focal area thereon for bombardment by the emitted electrons, the electron focal area including a molybdenum base alloy containing at least one of titanium and potassium oxide-silicon dioxide.

2. The X-ray tube according to claim 1, wherein said target means includes a supporting base for supporting said electron focal area;

said supporting base also including a molybdenum base alloy containing at least one of titanium and potassium oxide-silicon dioxide.

3. The X-ray tube according to claim 1, wherein the molybdenum base alloy contains titanium and also contains carbon.

4. The X-ray tube according to claim 1, wherein the molybdenum base alloy contains about 0.3 to about 4 wt % of titanium.

5. The X-ray tube according to claim 3 wherein the molybdenum base alloy contains about 0.3 to about 4 wt % of titanium and about 50 to about 400 ppm of carbon.

6. The X-ray tube according to claim 1, wherein the molybdenum base alloy contains a combination of about 0.01 to about 0.1 wt % potassium oxide and about 0.02 to about 0.3 wt % silicon dioxide.

7. The X-ray tube according to claim 1, wherein the molybdenum base alloy contains about 0.3 to about 4 wt % titanium, about 0.01 to about 0.1 wt % potassium oxide and about 0.02 to about 0.3 wt % silicon dioxide.

8. The X-ray tube according to claim 1, wherein said electron focal area has a thickness of at least about 0.2 mm.

* * * * *